US008696337B2

(12) United States Patent
Liu et al.

(10) Patent No.: US 8,696,337 B2
(45) Date of Patent: Apr. 15, 2014

(54) PLUNGER TYPE WATER PUMP

(75) Inventors: Yinshui Liu, Wuhan (CN); Defa Wu, Wuhan (CN); Zhuo Jiang, Wuhan (CN); Xiaofeng He, Wuhan (CN); Bihai Zhu, Wuhan (CN); Zhi-Heng Guo, Wuhan (CN); Xuyao Mao, Wuhan (CN); Jingyue Chen, Wuhan (CN)

(73) Assignee: Huazhong University of Science and Technology, Wuhan, Hubei Province (CN)

( * ) Notice: Subject to any disclaimer, the term of this patent is extended or adjusted under 35 U.S.C. 154(b) by 219 days.

(21) Appl. No.: 13/381,950

(22) PCT Filed: Sep. 28, 2010

(86) PCT No.: PCT/CN2010/077400

§ 371 (c)(1), (2), (4) Date: Dec. 31, 2011

(87) PCT Pub. No.: WO2012/037738

PCT Pub. Date: Mar. 29, 2012

(65) Prior Publication Data

US 2012/0201706 A1 Aug. 9, 2012

(51) Int. Cl.

| | |
|---|---|
| ***F04B 39/02*** | (2006.01) |
| ***F04B 39/10*** | (2006.01) |
| ***F04B 53/10*** | (2006.01) |
| ***F04B 27/10*** | (2006.01) |
| ***F04B 5/02*** | (2006.01) |
| ***F04B 1/14*** | (2006.01) |

(52) U.S. Cl.

CPC ..... *F04B 27/109* (2013.01); *F04B 5/02* (2013.01); *F04B 1/14* (2013.01)

USPC ..... 417/534; 91/502

(58) Field of Classification Search

CPC ..... F04B 27/109; F04B 5/02; F04B 1/14

USPC ..... 417/271, 415, 534, 539; 91/499, 502; 184/26, 27.1, 29

See application file for complete search history.

(56) References Cited

U.S. PATENT DOCUMENTS

| | | | | | |
|---|---|---|---|---|---|
| 2,690,133 | A | * | 9/1954 | Dodge | 417/269 |
| 2,969,810 | A | * | 1/1961 | Dudley | 137/625.15 |
| 3,249,052 | A | * | 5/1966 | Karlak | 417/494 |
| 4,615,257 | A | * | 10/1986 | Valentin | 91/499 |
| 5,988,987 | A | * | 11/1999 | Wolcott et al. | 417/54 |
| 6,079,313 | A | * | 6/2000 | Wolcott et al. | 92/71 |

* cited by examiner

*Primary Examiner* — Bryan Lettman

(74) *Attorney, Agent, or Firm* — Cheng-Ju Chiang

(57) ABSTRACT

A plunger type water pump mainly comprises a cavity body, a rotary main shaft and a plunger flow-distributing unit. The plunger flow-distributing unit comprises a flat valve assembly, a plunger-shoe assembly and a supporting valve assembly. The plunger-shoe assembly divides the cavity body into a high-pressure cavity and a low-pressure cavity independent of each other. The high-pressure cavity is in fluid communication with the flat valve assembly; and the low-pressure cavity is in fluid communication with the supporting valve assembly. The high-pressure water and the low-pressure water are independent of each other. This arrangement ensures a high volumetric efficiency of the water pump under ultra-high-pressure conditions and provides fluid support and lubrication for a friction coupling under high-speed heavy-load conditions to prolong the service life of the water pump.

10 Claims, 4 Drawing Sheets

PLUNGER TYPE WATER PUMP

CROSS REFERENCE TO RELATED APPLICATIONS

The present application is a 35 U.S.C. §371 National Phase conversion of International (PCT) Patent Application No. PCT/CN2010/077400, filed on Sep. 28, 2010, the disclosure of which is incorporated by reference herein. The PCT International Patent Application was published in Chinese.

FIELD OF THE INVENTION

The present disclosure generally relates to the technical field of positive displacement hydraulic pumps, and particularly, to a plunger type water pump. More particularly, the present disclosure relates to a fully water-lubricated ultra-high-pressure plunger type water pump.

BACKGROUND OF THE INVENTION

With the advent of the worldwide energy crisis and enhancement of people's environmental protection awareness, water hydraulic technologies have been found to have advantages over oil hydraulic systems in many application fields (e.g., during underwater operations, or in buoyancy adjustment of manned submersibles) owing to the special physicochemical properties of the water medium. Accordingly, water hydraulic technologies have experienced a rapid development.

However, because viscosity of the water is only about 1/30~1/50 of that of the commonly used hydraulic oil, it is less apt to form a water film and also has poor lubricity. Meanwhile, because of the strongly corrosive nature of the water and particularly the sea water, selection of materials used in water hydraulic systems is limited. This imposes great difficulties in design of friction couplings of water hydraulic elements. For these reasons, in contrast to oil hydraulic pumps, matured axial water hydraulic pumps are mostly designed to work at a medium or high pressure, which is usually 12 MPa~21 MPa.

A fully water-lubricated sea-water/fresh-water pump in the prior art adopts a plate valve for flow distribution, and has a flow rate of 10 L/min~170 L/min, a pressure of 14 MPa~16 MPa and an overall efficiency of higher than 82%. A schematic structural view of such a pump is shown in FIG. 1. As shown, this fully water-lubricated sea-water/fresh-water pump features a compact structure, full water lubrication of the friction couplings, and easy maintenance. Unfortunately, such a pump also suffers from the following shortcomings:

1. The maximum working pressure is 16 MPa, which cannot satisfy the needs in particular applications, for example, in the buoyancy adjusting system of a large-depth (i.e., the submerging depth exceeds 3,000 meters) manned submersible.

2. Distributing the flow by use of a valve plate is, on one hand, unsuitable for open systems because the valve plate is sensitive to pollutants, and on the other hand, makes it difficult to ensure the volumetric efficiency when the water is high-pressurized.

3. As a mechanism comprised of a swash plate and a shoe is used, a large lateral force is applied by the plunger to the cylinder. Hence, serious abrasion will occur to the friction coupling after the water is high-pressurized.

For water hydraulic pumps of higher pressures, a crankshaft and connecting-rod structure is usually adopted, and a mineral oil lubricated structure with the oil and the water being separated is used for the primary frictional coupling.

Water hydraulic pumps of this structure are one of the kinds that are the most widely used around the world, an example of which is a triple plunger pump in the prior art whose pressure range is 55 MPa~275 MPa. However, the water hydraulic pumps of this structure mainly have the following problems:

1) They have a low rotation speed (100 rev/min~500 rev/min), a bulky volume, and a small power-to-weight ratio. If the rotation speed is increased to decrease the volume of the pump, the seal between the water cavity and the lubricant oil cavity would be overheated and even fail, which is particularly the case under high-pressure conditions. Meanwhile, the temperature of the oil in the closed lubricant oil cavity may also increase due to poor heat dissipation to cause degradation of the oil.

2) Lubricant oil must be used for lubrication, which tends to cause oil pollution; furthermore, when the water hydraulic pumps are used in deep sea environments, an additional pressure compensation device must be used, which makes the whole structure very complex.

SUMMARY OF THE INVENTION

An objective of embodiments of the present disclosure is to provide a plunger type water pump that can achieve water lubrication of all friction couplings, surely have a high volumetric efficiency and a high power-to-weight ratio under ultra-high-pressure working conditions, and reduce the frictional abrasion of the friction couplings under high-speed heavy-load conditions so as to prolong the service life of the pump. The plunger water pump can suitably adopt the sea water or fresh water as a working medium, and can also suitably adopt other fluids of a low viscosity as a working medium.

To achieve the aforesaid objective, the plunger type water pump of the present disclosure comprises a pump body, a rotary unit and a plunger flow-distributing unit. The pump body comprises a cavity body, a water pump inlet and a water pump outlet; the rotary unit comprises a rotary main shaft and is disposed in the pump body; and the plunger flow-distributing unit is disposed in the pump body. The plunger flow-distributing unit comprises a flat valve assembly, a plunger-shoe assembly and a supporting valve assembly. The plunger-shoe assembly is disposed inside the cavity body and divides the cavity body into a high-pressure cavity, a low-pressure cavity and a lubrication cavity independent of each other; the supporting valve assembly is in fluid communication with the low-pressure cavity; the flat valve assembly is in fluid communication with the high-pressure cavity; and the rotary unit is disposed inside the lubrication cavity and is in fluid communication with the low-pressure cavity via a flow passage and the supporting valve assembly. Driven by the rotary main shaft, the plunger-shoe assembly reciprocates to impel the flat valve assembly and the supporting valve assembly to cooperate with each other so that the flat valve assembly takes in and discharges water through the water pump inlet and the water pump outlet respectively and the supporting valve assembly provides fluid lubrication for the rotary unit at the same time.

According to a preferred embodiment of the present disclosure, the flat valve assembly comprises an intake valve and a delivery valve formed integrally, an inlet of the intake valve is in fluid communication with the water pump inlet, an outlet of the delivery valve is in fluid communication with the water pump outlet, and an outlet of the intake valve is in fluid communication with an inlet of the delivery valve.

According to a preferred embodiment of the present disclosure, the rotary unit further comprises a reset spring, a set plate and a swash plate disposed in sequence on the rotary main shaft; the plunger-shoe assembly comprises a stepped plunger, a connecting rod and a shoe, wherein the connecting rod is movably connected to the stepped plunger and the shoe respectively at both ends thereof by means of ball friction couplings; and a plunger passage is further disposed in the cavity body, with an end of the stepped plunger being slidably disposed in the plunger passage, wherein: one side of the set plate makes contact with the reset spring, the other side of the set plate makes contact with the shoe, and under the action of the reset spring, the set plate presses a bottom of the shoe tightly against a surface of the swash plate so that rotating movement of the swash plate is transferred by the shoe and the connecting rod to the stepped plunger to impel the stepped plunger to reciprocate in the plunger passage, and the high-pressure cavity and the low-pressure cavity independent of each other are formed between a small-diameter end of the stepped plunger and the plunger passage and between a large-diameter end of the stepped plunger and the plunger passage respectively.

According to a preferred embodiment of the present disclosure, the plunger-shoe assembly further comprises a stepped plunger casing disposed in the plunger passage, and the stepped plunger is disposed inside and slidably makes direct contact with the stepped plunger casing.

According to a preferred embodiment of the present disclosure, the stepped plunger comprises recesses disposed on a surface thereof and damping holes that are disposed radially and in fluid communication with the high-pressure cavity, and the recesses are in communication with the damping holes.

According to a preferred embodiment of the present disclosure, the surface of the swash plate that makes contact with the bottom of the shoe is applied with a polymeric wear-resistant layer, and the polymeric wear-resistant layer is made of one of polyetheretherketone (PEEK) and polytetrafluoroethylene (PTFE).

According to a preferred embodiment of the present disclosure, a ball end of the connecting rod that forms one of the ball friction couplings with the stepped plunger is formed of two semi-spherical rings tightened together, a surface of each of the semi-spherical rings is formed with threads, and the semi-spherical rings are connected with one of the stepped plunger and the connecting rod by means of the threads.

According to a preferred embodiment of the present disclosure, the supporting valve assembly comprises a supporting intake valve and a supporting delivery valve, and the low-pressure cavity is in fluid communication with an outlet of the supporting intake valve and an inlet of the supporting delivery valve; the rotary unit further comprises an axial slide bearing and a radial slide bearing that mate with the rotary main shaft; and a fluid passage is disposed in the rotary main shaft and the pump body respectively to allow the supporting delivery valve to keep in fluid communication with the axial slide bearing and the radial slide bearing so that lubrication and supporting are achieved for the axial slide bearing and the radial slide bearing.

According to a preferred embodiment of the present disclosure, a stepped supporting cavity in fluid communication with the low-pressure cavity is disposed at the bottom of the shoe of the plunger-shoe assembly; and the rotary unit further comprises a damper disposed inside the pump body, the axial slide bearing is formed with an annular groove on an end surface thereof, the annular groove is in fluid communication with the damper, and the damper is further in fluid communication with an outlet of the supporting delivery valve through a flow passage formed inside the pump body.

The embodiments of the present disclosure have but are not limited to the following technical benefits:

1. Because all the friction couplings of the pump are lubricated by water as a working medium, the volume of the pump is reduced, and the heat generated during operation of the pump can be carried away by the working medium to ensure a low thermal equilibrium temperature of the pump. Because the full water lubrication makes it unnecessary to replace the lubricant oil of the pump periodically, the maintenance is simplified and the operational cost is reduced; meanwhile, the potential environmental pollution caused by leakage of the lubricant oil is avoided, which makes the pump environment friendly.

2. As the two closed cavities formed between the stepped plunger and the stepped plunger casing communicate respectively with the flat valve assembly and the supporting valve assembly that are independent of each other, the high-pressure water output by the ultra-high-pressure pump and the low-pressure water used for static-pressure supporting and lubrication are separated from each other, which can ensure a high volumetric efficiency of the ultra-high-pressure water pump under ultra-high-pressure conditions and surely provide the fluid supporting and lubrication for the friction couplings under high-speed heavy-load conditions.

3. Through the static- and dynamic-pressure mixed fluid supporting, the problem of serious frictional abrasion of the slide bearings lubricated by water under high-speed heavy-load conditions is solved, and full water lubrication is achieved for the high-pressure water pump. The fully water-lubricated ultra-high-pressure water pump is environment friendly and easy to maintain; and particularly when used in deep sea environments, it eliminates the need of an additional pressure compensation device as compared to the conventional high-pressure water pump where the oil and the water are separated from each other, and this can simplify the structure and improve the reliability.

4. The drive mechanism in the form of a swash plate and a connecting rod can reduce the lateral force applied by the plunger to the stepped plunger casing, thus easing the abrasion of this friction coupling.

5. The stepped plunger can reduce the contact specific pressure between the ball end of the connecting rod and the shoe under ultra-high-pressure conditions and increase the fluid supporting area of the shoe, thus improving the fluid supporting and lubrication performance between the shoe and the swash plate.

6. The spherical recesses formed on the plunger further communicate with the high-pressure cavity via fine damping holes to form a dual damping effect between the plunger and the stepped plunger casing, which can prevent sticking of the plunger and reduce the direct abrasion therebetween. The recesses on the surface of the plunger also helps to reduce the contact pressure between mating surfaces, restrict movement of abrasive particles and locally form a dynamic-pressure supporting effect, thus solving the problem of abrasion of the plunger coupling under high-speed heavy-load conditions and prolonging the service life of the ultra-high-pressure pump.

7. The flat valve is an integrated assembly in which the intake valve and the delivery valve are formed integrally, so it can be replaced promptly during maintenance to shorten the maintenance time. The flat valve is of a compact ball valve structure and adopts a soft material and a hard material in combination for sealing. Specifically, the valve seat is made of polyetheretherketone (PEEK) and the valve core is made of a ceramic material. This not only improves the sealing reliability under high-pressure conditions, but also reduces the impacting noise between the valve core and the valve seat, thus reducing the noise of the overall pump. The valve core is made of an engineering ceramic material. Because of the higher hardness and lower density of the ceramic material as compared to metal materials, this improves the resistance to cavitation corrosion, decreases the weight of the valve core, and improves the response characteristics and shortens the lagging time of the flat valve, thus improving the volumetric efficiency under high-speed conditions.

BRIEF DESCRIPTION OF THE DRAWINGS

In order to more clearly describe the technical solutions of the embodiments of the present disclosure, attached drawings to be used in the detailed description of the disclosure will be briefly described hereinbelow. Obviously, the attached drawings described hereinbelow only illustrate some of the embodiments of the present disclosure, and those of ordinary skill in the art can also obtain other attached drawings therefrom without the need of making inventive efforts, wherein:

FIG. 2 is a schematic structural view of a plunger type water pump according to an embodiment of the present disclosure, wherein

DETAILED DESCRIPTION OF THE INVENTION

Figure 1:
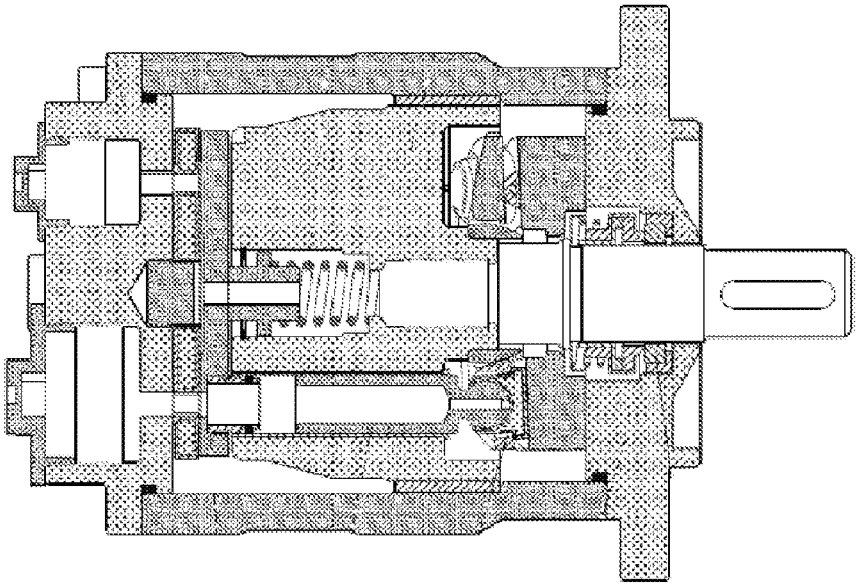
FIG. 1 (Prior Art)
FIG. 1 is a schematic structural view of a plunger type pump in the prior art.

Various embodiments of the disclosure are now described in detail. Referring to the drawings, like numbers indicate like parts throughout the views. As used in the description herein and throughout the claims that follow, the meaning of "a," "an," and "the" includes plural reference unless the context clearly dictates otherwise. Also, as used in the description herein and throughout the claims that follow, the meaning of "in" includes "in" and "on" unless the context clearly dictates otherwise.

A schematic structural view of a plunger type water pump according to an embodiment of the present disclosure is shown in FIG. 2. The plunger type water pump comprises a pump body, a rotary unit and a plunger flow-distribution unit. The pump body comprises a cavity body, a water pump inlet and a water pump outlet. The rotary unit comprises a rotary main shaft 1. The plunger flow-distributing unit mainly comprises a plunger-shoe assembly 23, a flat valve assembly 13 and a supporting valve assembly. The supporting valve assembly comprises a supporting intake valve 17 and a supporting delivery valve 18. The plunger-shoe assembly 23 is disposed in the cavity body and divides the cavity body into a high-pressure cavity 16, a low-pressure cavity 19 and a lubrication cavity 28 independent of each other. The supporting valve assembly is in fluid communication with the low-pressure cavity 19, the flat valve assembly 13 is in fluid communication with the high-pressure cavity 16, and the rotary unit is disposed inside the lubrication cavity 28 and is in fluid communication with the low-pressure cavity via a flow passage and the supporting valve assembly.

As shown, the pump body is mainly comprised of an end cover 10, a cylinder 9 and an enclosure 3. An end of the cylinder 9 is connected to the enclosure 3, and the other end of the cylinder 9 is provided with the end cover 10. Cavities in the end cover 10, the cylinder 9 and the enclosure 3 together form the aforesaid cavity body. The rotary main shaft 1 is fixed in the lubrication cavity 28 formed by the cylinder 9 and the enclosure 3. A plurality of plunger flow-distributing units (generally there are three to seven plunger flow-distributing units depending on different requirements on flow pulsing of the water hydraulic pump in different service environments) are uniformly distributed along a same circumference with the rotary main shaft 1 as a center. Hereinbelow, the structure and the operation process will be detailed.

A left end surface of the back end cover 10 is formed with two threaded holes for use as an inlet and an outlet of the ultra-high-pressure water pump respectively, and a right end surface of the back end cover 10 is formed with a flow hole 11 and an annular flow groove 14. Stepped holes, a number of which is equal to the number of the plunger flow-distributing units, are formed in a radial direction and uniformly distributed in a circumferential direction of the back end cover 10. Each of the stepped holes is formed with threads at the outer side for installing and fixing the flat valve assembly 13. Once the flat valve assembly is installed in place, a locking nut 12 is used to lock the flat valve assembly 13 so that loosing of the flat valve assembly 13 under the action of the cycling hydraulic pressure can be prevented, thus improving the reliability in use of the sea water/fresh water pump in underwater environments.

Figure 3:
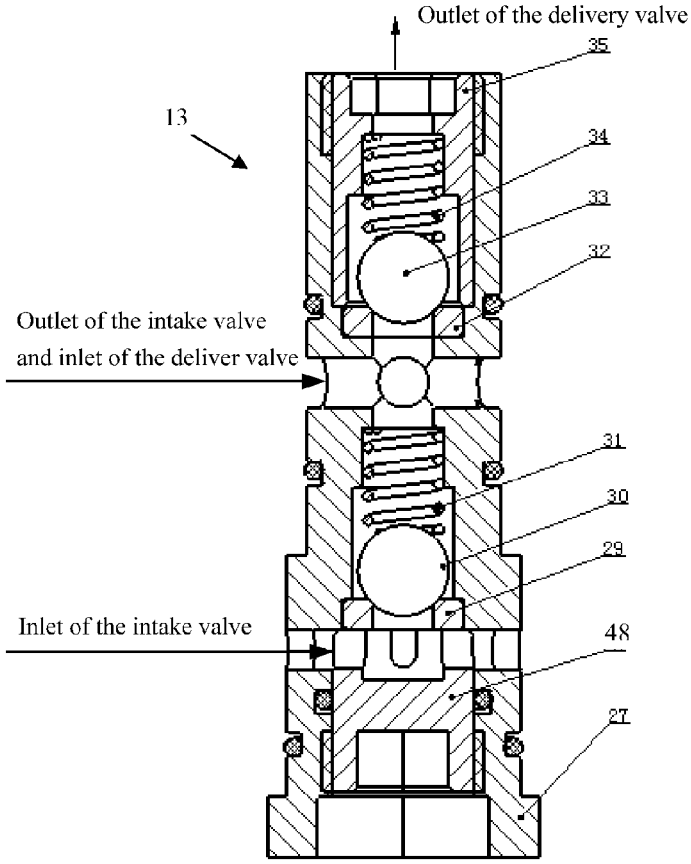
FIG. 3 is a schematic structural view of a flat valve assembly of the plunger type water pump shown in FIG. 2.

As shown in FIG. 3, the flat valve assembly comprises a valve body 27, an intake valve and a delivery valve. An inlet of the intake valve communicates with an inlet of the water pump via the annular flow groove 14, an outlet of the intake valve communicates with an inlet of the delivery valve, and an outlet of the delivery valve communicates with an outlet of the water pump. As shown, the delivery valve is installed at a top portion of the valve body 27, and the intake valve is installed at a bottom portion of the valve body 27. The delivery valve comprises, in sequence from top to bottom, a delivery valve locking nut 35, a delivery valve spring 34, a delivery valve core 33 and a delivery valve seat 32; and the intake valve comprises, in sequence from top to bottom, an intake valve spring 31, an intake valve core 30, an intake valve seat 29 and an intake locking nut 48. An interface between the delivery valve and an intake valve serves as both the outlet of the intake valve and an inlet of the delivery valve. By designing the intake valve and the delivery valve into a single assembly, the flat valve assembly can be replaced as a whole during the maintenance period to shorten the mean time to repair (MTTR) and to improve the on-site maintenance ability.

The radial arrangement of the flat valve assembly reduces the axial dimension of the water pump and increases the power-to-weight ratio. The flat valve adopts a seal form of a ball valve and adopts a soft material and a hard material in combination for sealing; specifically, the valve seat is made of PEEK and the valve core is made of ceramic. Such a compact structure not only improves the sealing reliability under high-pressure conditions, but also reduces the impacting noise between the valve core and the valve seat, thus reducing the noise of the overall pump. Because the valve core is made of a ceramic material which has a higher hardness and a lower density than metal materials, this improves the resistance to cavitation corrosion, decreases the weight of the valve core, and improves the response characteristics and shortens the lagging time of the flat valve, thus improving the volumetric efficiency under high-speed conditions.

Figure 4:
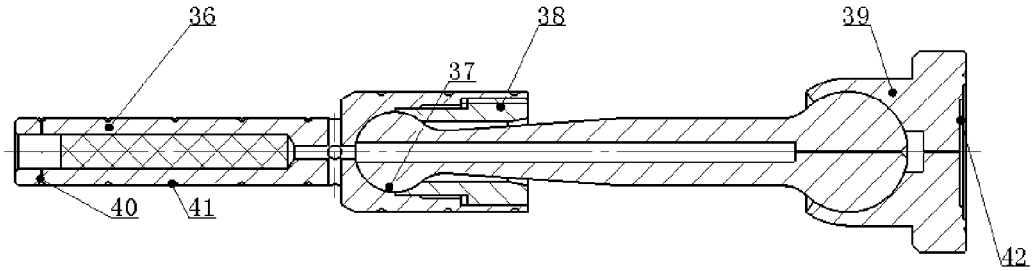
FIG. 4 is a schematic structural view of a plunger-shoe assembly of the plunger type water pump shown in FIG. 2.
Figure 5:
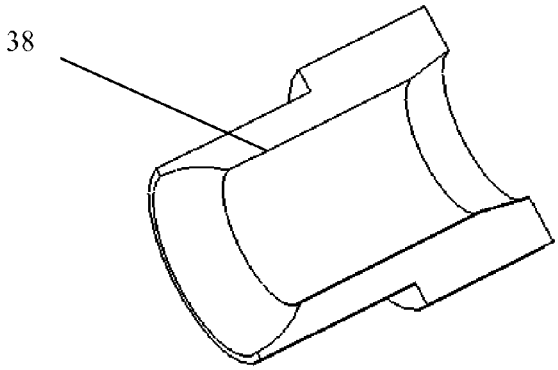
FIG. 5 is a schematic structural view of a semi-spherical ring of the plunger-shoe assembly shown in FIG. 4.
Figure 6:
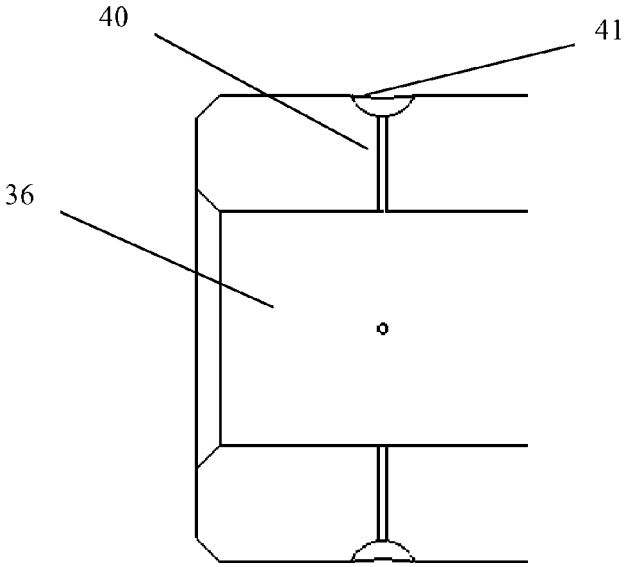
FIG. 6 is a schematic partial structural view of a stepped plunger of the plunger-shoe assembly shown in FIG. 4, which illustrates an anti-sticking damping structure in detail.

The cylinder 9 is formed with a flow passage 8 in order for the water pump inlet to communicate with the lubrication cavity. In the axial direction, the cylinder 9 is formed with a stepped hole in communication with the plunger piston, and in the radial direction, stepped holes twice as many as the plunger flow-distribution units are distributed and communicate with the axial stepped hole in groups of two. The stepped plunger casing 7 is installed in the axial stepped hole, and each group of radially distributed stepped holes is used to install the supporting intake valve 17 and the supporting delivery valve 18. The inlet of the supporting intake valve 17 communicates with an inlet of the ultra-high-pressure sea water pump via the flow passage 15 and the annular flow groove 14 of the back end cover. The stepped plunger assembly 23 is installed in the stepped plunger casing 7, as shown in FIG. 4. The stepped plunger assembly 23 comprises a stepped plunger 36, semi-spherical rings 38, a connecting rod 37 and a shoe 39. The connecting rod 37 is formed with an elongate damping hole that communicates with the supporting cavity 42 located at the bottom of the shoe 39, and the supporting cavity 42 is of a multi-step structure. At a large-diameter end of the stepped plunger is formed with a stepped threaded hole, and a ball socket is formed at the bottom of the threaded hole. Each of the stepped plunger assemblies 23 has two semi-spherical rings 38 as shown in FIG. 5, which are formed by fabricating a part having male threads and a ball socket and then splitting the part into two pieces. The male threads of the two semi-spherical rings 38 mate with female threads of the plunger, and the ball socket mates with the ball end of the connecting rod. The two ends of the connecting rod 37 are ball ends of different sizes, with the smaller ball end being adapted to mate with the ball socket of the plunger. Then, the pair of semi-spherical rings is threaded into the threads of the stepped plunger 36 so that the connecting rod is connected to the stepped plunger 36 with a ball friction coupling being formed therebetween. This structure eliminates the plastic deformation that would occur on the plunger surface when the smaller ball end of the connecting rod is connected to the plunger by means of the common rolling process, so the accuracy of fit between the plunger surface and the plunger hole is improved to result in both an improved sealing performance and improved friction behaviors. The larger ball end of the connecting rod and the ball socket of the shoe mate with each other, and may be connected together through a rolling process to form a ball friction coupling. The stepped plunger 36 is formed with spherical recesses 41 and fine damping holes 40 on a surface of the small-diameter end, as shown in FIG. 6.

The drive mechanism in the form of a swash plate and a connecting rod mainly helps to reduce the lateral force between the stepped plunger 36 and the stepped plunger casing 7 as well as the bending moment borne by the stepped plunger 36. Between the small-diameter end of the plunger and the stepped plunger casing 7 is formed the high-pressure cavity 16, which communicates with the water pump outlet via the flat valve located on the end cover so as to output the ultra-high-pressure water; and between the large-diameter end of the plunger and the stepped plunger casing 7 is formed the low-pressure cavity 19, which communicates with the supporting cavity 42 of the shoe 39 so as to provide the static-pressure supporting between the shoe 39 and the swash plate. The static-pressure supporting and the dynamic-pressure supporting generated by the supporting cavity 42 of the multi-step structure at the bottom of the shoe 39 coact to improve the supporting performance between the shoe and the swash plate. The water medium used for supporting flows through an axial gap between the shoe 39 and the swash plate into the lubrication cavity 28 (as shown in FIG. 2) which communicates with the pump inlet. The low-pressure cavity 19 further communicates with the outlet of the supporting intake valve 17 and the inlet of the supporting delivery valve 18 to provide pressure supporting for the axial slide bearing 6 and the radial slide bearings 5 and 20 via the supporting delivery valve 18, thus accomplishing the static- and dynamic-pressure mixed supporting and lubrication. The spherical recesses 41 on the surface of the stepped plunger 36 communicates with the high-pressure cavity 16 via the fine damping holes 40 and a row of recesses located on an end of the stepped plunger so as to provide a dual damping effect between the stepped plunger 36 and the stepped plunger casing 7. This solves the problem of sticking of the plunger caused by reducing the gap between the stepped plunger casing 7 and the stepped plunger 36 in order to improve the volumetric efficiency of the ultra-high-pressure pump, and makes it less likely for the stepped plunger 36 and the stepped plunger casing 7 to make direct contact with each other. These recesses not only reduce the contact stress between the mating surfaces and restrict movement of abrasive particles, but also locally form a dynamic-pressure supporting effect. By means of the connecting rod mechanism, the two-stage damping and appropriate design of the surface morphology, abrasion of the plunger friction coupling under high-speed heavy-load conditions is avoided.

A left end of the rotary main shaft 1 is connected to the cylinder 9 via the radial slide bearing 20, while a right end of the rotary main shaft 1 is connected to the enclosure 3 via the axial slide bearing 6 and the radial slide bearing 5 and extends out of the enclosure 3 through the mechanical seal 2. A left end surface of the axial slide bearing 6 is formed with an annular groove and a spherical recess. The annular groove communicates with the damper 4 which, in turn, communicates with the outlet of the supporting delivery valve 18 via the flow passage 26 of the enclosure 3. By means of the damper 4, the supporting pressure of the axial slide bearing 6 can vary with the load. The rotary main shaft 1 is formed with a flow passage 47 so that the pressurized water can flow through an interior of the axial slide bearing 6 to the radial slide bearings 5 and 20 for purpose of pressure supporting, lubrication and cooling. This portion of water medium for lubrication and cooling flows through the axial slide bearing 6 and the radial slide bearings 5 and 20 into the lubrication cavity 28 formed by the enclosure 3 and the cylinder 9, and flows to the inlet of the pump through the flow passage 8 of the cylinder that communicates with the lubrication cavity. The radial slide bearings 5 and 20 are designed as an eccentric structure that produces a dynamic pressure under the action of the water medium, so the static- and dynamic-pressure mixed supporting and lubrication are achieved. The rotary main shaft 1 is formed with a swash plate 24, a side surface of which includes an angle of 7°~15° with the rotary main shaft. A polymer material (e.g., PEEK or PTFE) is applied on a left side of the swash plate so that the polymer material makes direct contact with the shoe to improve the frictional characteristics therebetween.

Figure 2A:
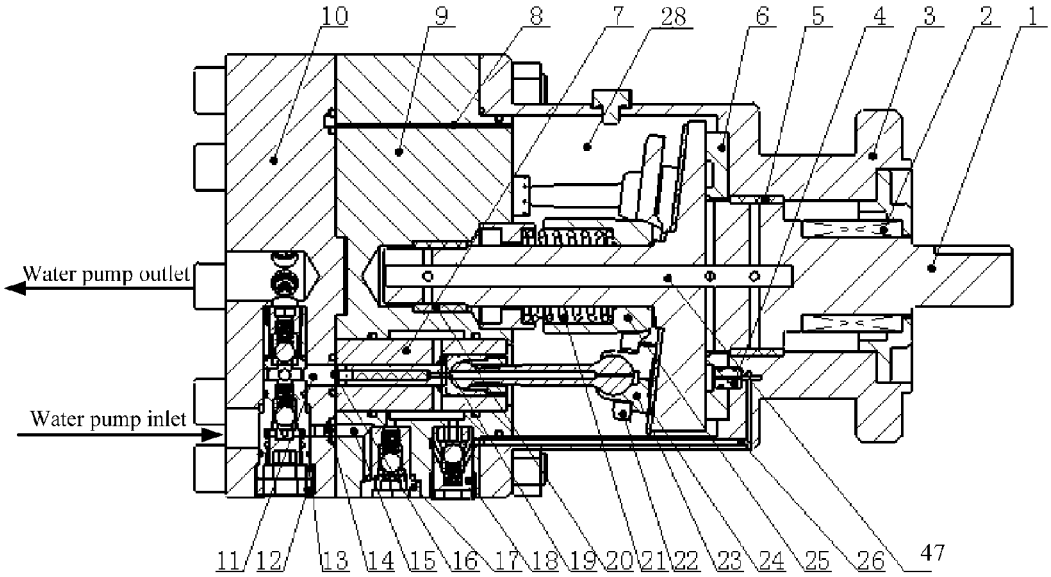
FIG. 2*a* shows a status in which the high-pressure cavity has the minimum volume and FIG. 2*b* shows a status in which the high-pressure cavity has the maximum volume.
Figure 2B:
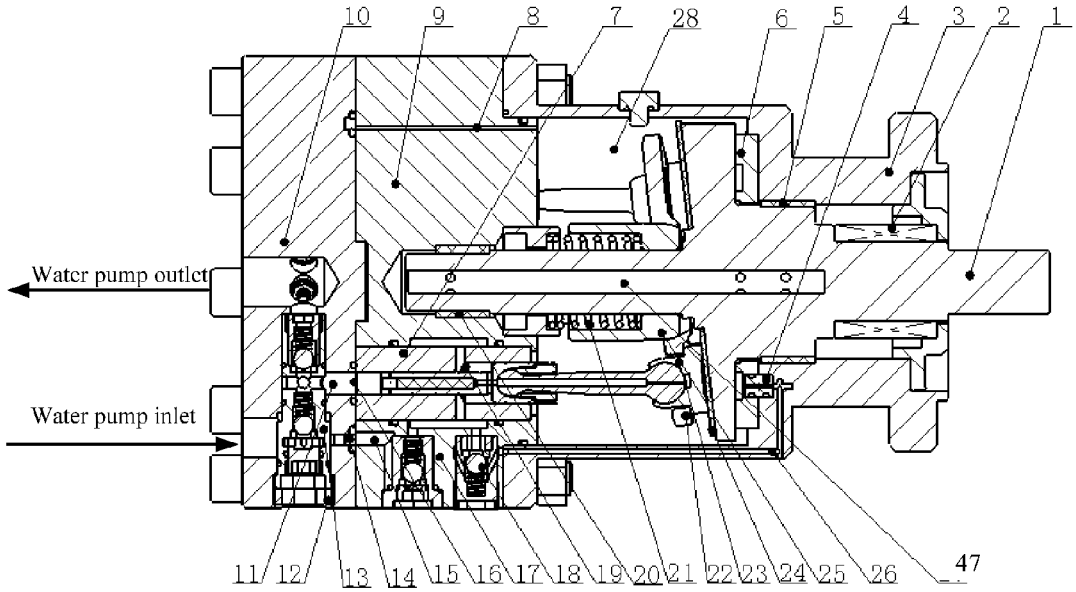

The ultra-high-pressure water pump works as follows. The rotary main shaft 1 rotates clockwise or counterclockwise, and the swash plate 24 rotates along with the rotary main shaft 1. Through a spherical hinge 25 and a set plate 22, the reset spring 21 applies a force to the shoe 39 uniformly to drive the shoe 39 to slide against the swash plate 24. The force applied by the swash plate 24 to the shoe 39 is received by the stepped plunger 36 via the connecting rod 37, and then the stepped plunger 36 reciprocates within the stepped plunger casing 7 accordingly. When the swash plate 24 begins to move from a limit position where the high-pressure cavity 16 has the minimum volume (as shown in FIG. 2*a*), the valve core 33 of the delivery valve of the flat valve assembly 13 is in a closed status. Under the action of the pressing force from the set plate 22, the shoe 39 drives the stepped plunger 36 to move rightwards to cause a gradual increase in volume of the high-pressure cavity 16. Correspondingly, the pressure decreases. Once the pressure decreases to a certain value and a pressure at the water inlet of the intake valve 30 becomes greater than a resulting force of the pressure inside the high-pressure cavity 16 and the force applied by the spring of the intake valve, the intake valve is opened to allow the water to flow through the inlet of the water pump into the inlet of the intake valve and further into the high-pressure cavity 16, thus accomplishing a process of water intake. On the other hand, when the swash plate 24 rotates from the limit position shown in FIG. 2*a* by 180° to a position where the high-pressure cavity 16 has the maximum volume as shown in FIG. 2*b*, the stepped plunger 36 is in a fully extended status. As the rotary main shaft 1 continues to rotate, the shoe 39 driven by the swash plate 24 will impel the plunger 39 to move leftwards to cause a gradual decrease in volume of the high-pressure cavity 16. Correspondingly, the pressure in the high-pressure cavity increases to such an extent that the intake valve is closed and a resulting force of the force of the spring 34 of the delivery valve and the pressure at the water pump outlet is overcome. As a result, the valve core 33 of the delivery valve is opened to allow the high-pressure water in the high-pressure cavity 16 to flow through the outlet of the delivery valve to the water pump outlet, thus accomplishing a discharging process. The plunger cycles through one intake process and one discharging process during each turn of the rotary main shaft's rotation, and as the rotary main shaft rotates continuously, the plunger cycles through the intake process and the discharging process repeatedly to output a flow continuously from the pump. During a 360° rotation of the rotary main shaft, the low-pressure cavity 19 formed by the stepped plunger 36 and the stepped plunger casing 7 also varies correspondingly. Specifically, when the volume of the low-pressure cavity 19 increases, water is taken in through the supporting intake valve 17; and when the volume of the low-pressure cavity 19 decreases, a part of the pressurized water flows through the flow passage into the ball friction coupling of the connecting rod and then flows through the connecting rod to the bottom of the shoe 39 to support the shoe 39, while the other part of the pressurized water flows through the flow passage 26 of the cylinder to the damper 4 and then through the damper 4 to the annular groove of the axial slide bearing 6 for supporting and lubrication purpose. The pressurized water flowing from inside the axial slide bearing 6 flows through the flow passage 47 inside the rotary main shaft to the left and the right radial slide bearings 5 and 20 to provide the static-pressure supporting. Thus, in consideration of the dynamic-pressure supporting provided by the radial slide bearings themselves, the static- and dynamic-pressure mixed supporting and lubrication are achieved.

What described above is a preferred embodiment of the present disclosure. It shall be appreciated that, the embodiment described above may have a number of variants. For example, it is possible that the stepped plunger casing 7 is eliminated and the stepped plunger 36 is directly placed into a corresponding plunger passage in the cavity. Additionally, it is shown in FIG. 4 that the large-diameter end of the stepped plunger 36 in the plunger-shoe assembly 23 is a ball socket structure and an end of the connecting rod 37 that connects to the stepped plunger 16 is formed as a ball end; however, the present disclosure is not limited thereto in practical applications, and it is also possible that the ball end is disposed on the stepped plunger 36 while the ball socket is disposed on the connecting rod, in which case a threaded connection is needed between the semi-spherical rings 38 and the connecting rod 37. Furthermore, although this embodiment of the present disclosure is described with reference to a high-pressure fully water-lubricated water pump, the present disclosure is not merely limited thereto but may also be applied to other plunger type pumps that are not fully water lubricated or even not have a high pressure. Therefore, scope of the present disclosure shall be governed by the claims.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A plunger type water pump, comprising:

a pump body, comprising a cavity body, a water pump inlet and a water pump outlet;

a rotary unit, comprising a rotary main shaft and being disposed in the pump body; and a plunger flow-distributing unit, being disposed in the pump body, wherein the plunger flow-distributing unit comprises a flat valve assembly, a plunger-shoe assembly and a supporting valve assembly;

wherein the plunger-shoe assembly is disposed inside the cavity body and divides the cavity body into a high-pressure cavity, a low-pressure cavity and a lubrication cavity independent of each other, the supporting valve assembly is in fluid communication with the low-pressure cavity, the flat valve assembly is in fluid communication with the high-pressure cavity, and the rotary unit is disposed inside the lubrication cavity and is in fluid communication with the low-pressure cavity via a flow passage and the supporting valve assembly; and wherein, driven by the rotary main shaft, the plunger-shoe assembly reciprocates to impel the flat valve assembly and the supporting valve assembly to cooperate with each other so that the flat valve assembly takes in and discharges water through the water pump inlet and the water pump outlet respectively and the supporting valve assembly provides fluid lubrication for the rotary unit at the same time.

2. The plunger type water pump of claim 1, wherein the flat valve assembly comprises an intake valve and a delivery valve formed integrally, an inlet of the intake valve is in fluid communication with the water pump inlet, an outlet of the delivery valve is in fluid communication with the water pump outlet, and an outlet of the intake valve is in fluid communication with an inlet of the delivery valve.

3. The plunger type water pump of claim 1, wherein:

the rotary unit further comprises a reset spring, a set plate and a swash plate disposed in sequence on the rotary main shaft;

the plunger-shoe assembly comprises a stepped plunger, a connecting rod and a shoe, wherein the connecting rod is movably connected to the stepped plunger and the shoe respectively at both ends thereof by means of ball friction couplings;

a plunger passage is further disposed in the cavity body, with an end of the stepped plunger being slidably disposed in the plunger passage;

wherein one side of the set plate makes contact with the reset spring, the other side of the set plate makes contact with the shoe, and under the action of the reset spring, the set plate presses a bottom of the shoe tightly against a surface of the swash plate so that rotating movement of the swash plate is transferred by the shoe and the connecting rod to the stepped plunger to impel the stepped plunger to reciprocate in the plunger passage, and wherein the high-pressure cavity and the low-pressure cavity independent of each other are formed between a small-diameter end of the stepped plunger and the plunger passage and between a large-diameter end of the stepped plunger and the plunger passage respectively.

4. The plunger type water pump of claim 3, wherein the plunger-shoe assembly further comprises a stepped plunger casing disposed in the plunger passage, and the stepped plunger is disposed inside and slidably makes direct contact with the stepped plunger casing.

5. The plunger type water pump of claim 4, wherein the stepped plunger comprises recesses disposed on a surface thereof and damping holes that are disposed radially and in fluid communication with the high-pressure cavity, and the recesses are in communication with the damping holes.

6. The plunger type water pump of claim 3, wherein the surface of the swash plate that makes contact with the bottom of the shoe is applied with a polymeric wear-resistant layer.

7. The plunger type water pump of claim 6, wherein the polymeric wear-resistant layer is made of one of polyetheretherketone (PEEK) and polytetrafluoroethylene (PTFE).

8. The plunger type water pump of claim 3, wherein a ball end of the connecting rod that forms one of the ball friction couplings with the stepped plunger is formed of two semi-spherical rings tightened together, a surface of each of the semi-spherical rings is formed with threads, and the semi-spherical rings are connected with one of the stepped plunger and the connecting rod by means of the threads.

9. The plunger type water pump of claim 1, wherein:

the supporting valve assembly comprises a supporting intake valve and a supporting delivery valve, and the low-pressure cavity is in fluid communication with an outlet of the supporting intake valve and an inlet of the supporting delivery valve;

the rotary unit further comprises an axial slide bearing and a radial slide bearing that mate with the rotary main shaft; and a fluid passage is disposed in the rotary main shaft and the pump body respectively to allow the supporting delivery valve to keep in fluid communication with the axial slide bearing and the radial slide bearing so that lubrication and supporting are achieved for the axial slide bearing and the radial slide bearing.

10. The plunger type water pump of claim 9, wherein:

a stepped supporting cavity in fluid communication with the low-pressure cavity is disposed at the bottom of the shoe of the plunger-shoe assembly; and the rotary unit further comprises a damper disposed inside the pump body, the axial slide bearing is formed with an annular groove on an end surface thereof, the annular groove is in fluid communication with the damper, and the damper is further in fluid communication with an outlet of the supporting delivery valve through a flow passage formed inside the pump body.

* * * * *